US008925429B2

(12) United States Patent
Johnson et al.

(10) Patent No.: US 8,925,429 B2
(45) Date of Patent: Jan. 6, 2015

(54) RADIAL FOLDOUT TOOL

(75) Inventors: Ronald L. Johnson, San Jose, CA (US); Robert J. Gallegos, Fremont, CA (US); Steven Simas Escobar, San Jose, CA (US); Anders Scot Hudson, Campbell, CA (US); Idriss Mansouri-Chafik Ruiz, San Jose, CA (US); Yugen Patrick Lockhart, Palo Alto, CA (US); Howard Allen Wilson, Santa Clara, CA (US); Eric M. Colton, Menlo Park, CA (US)

(73) Assignee: WAGIC, Inc., San Jose, CA (US)

( * ) Notice: Subject to any disclaimer, the term of this patent is extended or adjusted under 35 U.S.C. 154(b) by 0 days.

(21) Appl. No.: 12/009,461

(22) Filed: Jan. 17, 2008

(65) Prior Publication Data

US 2009/0183609 A1 Jul. 23, 2009

(51) Int. Cl.

| | |
|---|---|
| ***B25B 23/00*** | (2006.01) |
| ***B25G 1/08*** | (2006.01) |
| ***B25G 1/06*** | (2006.01) |
| ***B25F 1/04*** | (2006.01) |
| *B26B 11/00* | (2006.01) |
| *B25B 15/00* | (2006.01) |

(52) U.S. Cl.

CPC *B25G 1/085* (2013.01); *B25G 1/08* (2013.01); *B25G 1/066* (2013.01); *B25F 1/04* (2013.01); *B26B 11/001* (2013.01); *B25B 15/008* (2013.01)

USPC ..... 81/440; 7/118

(58) Field of Classification Search

CPC ..... B25G 1/085; B25G 1/08; B25F 1/04; B26B 11/001

USPC ..... 81/436–440, 490, 177.4, 177.6, 177.2; D8/105, 82–85; 7/118

See application file for complete search history.

(56) References Cited

U.S. PATENT DOCUMENTS

| | | | |
|---|---|---|---|
| 244,309 | A | 7/1881 | Rhodes |
| 363,331 | A | 5/1887 | Hammer |
| 364,422 | A | 6/1887 | Laforge |
| 580,235 | A | 4/1897 | Strum |
| 647,528 | A | 4/1900 | Schmidt |
| 763,745 | A | 6/1904 | Gheen |
| 873,363 | A | 12/1907 | Ross |
| 875,493 | A | 12/1907 | Beard |

(Continued)

FOREIGN PATENT DOCUMENTS

| | | | |
|---|---|---|---|
| CA | 1 147 176 | 5/1983 | ..... B25B 13/06 |
| CA | 1232781 A | 2/1988 | |

(Continued)

*Primary Examiner* — Bryan R Muller

(74) *Attorney, Agent, or Firm* — Haverstock & Owens LLP

(57) ABSTRACT

A radial foldout tool includes a body with opposing ends and one or more sets of tool drivers. A first set of tool drivers are positioned on/near a first end and a second set of tool drivers are positioned on/near a second end. The tool drivers are contained within channels of the body when in a closed position. The tool drivers are also contained in a plurality of planes. The tool drivers open by rotating/moving in a direction at least perpendicular to a neighboring tool driver. When they are in an open position, each of the tool drivers are in/near the center of the end of the body. By being positioned in/near the center of the end, the radial foldout tool is able to be gripped and turned in a fashion similar to a standard screwdriver.

24 Claims, 8 Drawing Sheets

(56) References Cited

U.S. PATENT DOCUMENTS 959,408 A 5/1910 Volbert
1,000,900 A 8/1911 Dorsey
1,006,679 A 10/1911 Rice
1,100,070 A 6/1914 Graham
1,172,656 A 2/1916 Yorgensen
1,187,842 A 6/1916 Kaas
D53,597 S 7/1919 Marcmann
1,337,769 A 4/1920 Hemming
1,398,583 A 11/1921 Bovee
1,425,270 A 8/1922 Morgan
1,500,852 A 7/1924 Shepard
1,502,044 A 7/1924 McCann
1,530,905 A 3/1925 Nance
1,559,097 A 10/1925 Hill
1,753,026 A 4/1930 Rosati
1,825,936 A 10/1931 Bodmer
1,888,222 A 11/1932 Curtis et al.
1,915,245 A 6/1933 Cook
1,970,409 A 8/1934 Wiedemann
2,332,656 A 10/1943 Mirando ..... 30/22
2,346,364 A 4/1944 Dowe ..... 279/83
D142,982 S 11/1945 Bloomfield
2,409,613 A 10/1946 Brooks ..... 306/32
2,410,971 A 11/1946 Hartley
2,465,152 A 3/1949 Ellison
2,465,619 A 3/1949 Veit ..... 306/32
2,475,268 A 7/1949 Wittle ..... 279/14
2,485,991 A 10/1949 Stowell
D156,677 S 12/1949 Smith ..... D17/14
D157,154 S 2/1950 Horton ..... D58/11
2,512,967 A 6/1950 Quiron ..... 145/50
2,530,024 A 11/1950 Moody ..... 206/17
2,532,636 A 12/1950 Minnich ..... 206/16
2,569,069 A 9/1951 Motel ..... 145/50
2,590,307 A 3/1952 Gibson
2,593,828 A 4/1952 Arey ..... 81/177
2,701,052 A 2/1955 Martel
D175,056 S 6/1955 Wilson
2,715,028 A 8/1955 Dossie ..... 279/9
2,719,042 A 9/1955 Epsy ..... 279/9
2,776,589 A 1/1957 Gregory
2,778,396 A 1/1957 Swain
2,800,816 A 7/1957 Tasciotti
2,804,970 A 9/1957 Kuc et al. ..... 206/16
2,836,210 A 5/1958 Garofalo
2,842,020 A 7/1958 Tarquinio ..... 81/177
2,844,244 A 7/1958 Hanson
2,854,741 A 10/1958 Cholger
2,878,701 A 3/1959 Weersma
3,023,054 A 2/1962 Chigekuni
3,061,927 A 11/1962 Von Frankenberg Und Ludwigsdorf ..... 30/156
3,113,479 A 12/1963 Swingle ..... 81/177
3,156,143 A 11/1964 Wolf
3,222,959 A 12/1965 Clark
3,255,792 A 6/1966 Beck
3,257,991 A 6/1966 Mosch ..... 120/1
D205,745 S 9/1966 Nannfeldt ..... D80/9
3,342,229 A 9/1967 Janes
3,343,434 A 9/1967 Schroeder
3,370,696 A 2/1968 Groe
3,424,039 A 1/1969 Scott
3,592,086 A 7/1971 Derwin ..... 81/177 A
3,654,975 A 4/1972 Ballsmith et al.
3,667,518 A 6/1972 Stillwagon, Jr.
3,802,286 A 4/1974 Winklhofer et al. .... 74/242.11 S
3,863,693 A 2/1975 Carriker
3,943,801 A 3/1976 Yates ..... 81/71
3,958,469 A 5/1976 Meese
4,000,767 A 1/1977 Geng
4,043,230 A 8/1977 Scrivens ..... 81/177 A
4,124,915 A 11/1978 Schlicher
4,154,125 A 5/1979 Frank ..... 74/553
4,196,761 A 4/1980 Royer
4,227,430 A 10/1980 Jansson et al. ..... 81/177 M
4,235,269 A 11/1980 Kraus
4,238,862 A 12/1980 Leatherman
4,241,773 A 12/1980 Personnat
4,302,990 A 12/1981 Chrichton et al. ..... 81/60
4,308,770 A 1/1982 MacDonald
4,327,790 A * 5/1982 Stevens et al. ..... 81/177.4
4,384,499 A 5/1983 Shockley ..... 81/440
4,424,728 A 1/1984 MacDonald ..... 81/177
4,448,097 A 5/1984 Rocca
4,469,109 A 9/1984 Mehl
4,476,751 A 10/1984 Mishima
4,525,889 A 7/1985 Dunau
4,542,667 A 9/1985 Jang
D284,810 S 7/1986 Kelemen, Sr.
4,699,020 A 10/1987 Bush et al.
4,699,030 A 10/1987 Yang
4,703,673 A 11/1987 Allen
4,711,353 A 12/1987 Rozmestor ..... 206/378
4,716,795 A 1/1988 Corona et al. ..... 81/177.4
4,716,796 A 1/1988 Corona et al. ..... 81/177.4
4,767,006 A 8/1988 Wasem
4,783,867 A 11/1988 Tsao
4,787,276 A 11/1988 Condon ..... 81/177.1
4,815,346 A * 3/1989 Littlehorn ..... 81/177.4
4,819,523 A 4/1989 Souza
4,819,800 A 4/1989 Wilson
4,820,090 A 4/1989 Chen ..... 408/241 R
D302,102 S 7/1989 Amagaya
4,882,841 A 11/1989 Margolis ..... 30/125
4,922,569 A 5/1990 Brinker et al.
4,926,721 A 5/1990 Hsiao ..... 81/177.4
D308,462 S 6/1990 Komatsu ..... D8/105
4,934,223 A 6/1990 Wong ..... 81/490
D311,124 S 10/1990 Learney
4,960,016 A 10/1990 Seals
4,974,477 A 12/1990 Anderson
4,979,407 A 12/1990 Hernandez et al. ..... 81/3.09
5,029,707 A 7/1991 Feng ..... 206/374
5,036,975 A 8/1991 Chow
5,062,173 A 11/1991 Collins et al. ..... 7/118
5,063,796 A 11/1991 Gennep
5,065,487 A 11/1991 Yother
5,086,674 A 2/1992 Her
5,146,815 A 9/1992 Scott, III ..... 81/437
5,147,038 A 9/1992 Pergeau
D333,769 S 3/1993 Jureckson ..... D8/71
D334,516 S 4/1993 Tsunoda ..... D8/29
D339,048 S 9/1993 Baum ..... D8/107
5,251,352 A 10/1993 Cullison
5,263,389 A 11/1993 Frazell et al. ..... 81/124.3
5,265,504 A 11/1993 Fruhm ..... 81/439
D342,433 S 12/1993 Sorenson ..... D8/107
5,271,300 A 12/1993 Zurbuchen et al. ..... 81/124.4
D343,106 S 1/1994 Eklind et al. ..... D8/71
5,295,422 A 3/1994 Chow
5,320,004 A 6/1994 Hsiao ..... 81/440
5,329,834 A 7/1994 Wong ..... 81/58.3
5,394,984 A 3/1995 Aiba
D359,671 S 6/1995 Acosta
5,450,774 A 9/1995 Chang ..... 81/440
5,450,775 A 9/1995 Kozak ..... 81/440
5,461,950 A 10/1995 Iwinski
5,480,166 A 1/1996 Milsop
5,495,942 A 3/1996 Izhak ..... 206/372
5,499,560 A 3/1996 Aeschliman
5,499,562 A 3/1996 Feng ..... 81/177.4
5,517,885 A 5/1996 Feng ..... 81/177.4
5,522,291 A 6/1996 Liu ..... 81/490
5,535,882 A 7/1996 Liu ..... 206/377
5,542,322 A 8/1996 Knox et al.
D373,943 S 9/1996 Fuhrmann ..... D8/71
5,553,340 A 9/1996 Brown, Jr. ..... 7/118
5,566,596 A 10/1996 Lin ..... 81/490
D376,520 S 12/1996 Morin ..... D8/14
5,581,834 A 12/1996 Collins ..... 7/118
D377,444 S 1/1997 Lin ..... D8/107
5,592,859 A 1/1997 Johnson et al. ..... 81/177.4
D378,797 S 4/1997 Poremba et al. ..... D8/107
D380,131 S 6/1997 Sung

(56) References Cited

U.S. PATENT DOCUMENTS

D382,190 S 8/1997 Blackston et al. ..... D8/107
5,653,525 A 8/1997 Park
D383,048 S 9/1997 Sorenson et al. ..... D8/107
5,662,013 A 9/1997 Lin ..... 81/490
D385,172 S 10/1997 Bramsiepe et al. ..... D8/83
D386,955 S 12/1997 Jones et al.
5,692,659 A 12/1997 Dembicks
5,711,042 A 1/1998 Chuang ..... 7/138
5,711,194 A 1/1998 Anderson et al.
D394,792 S 6/1998 Bourque
D394,794 S 6/1998 Vasudeva ..... D8/107
5,758,870 A 6/1998 Weaver
5,765,247 A 6/1998 Seber et al. ..... 7/128
5,765,454 A 6/1998 Barbulescu et al.
5,768,960 A 6/1998 Archuleta
5,791,211 A 8/1998 Bondhus et al. ..... 81/440
5,803,584 A * 9/1998 Chung ..... 362/120
5,820,288 A 10/1998 Cole
D400,775 S 11/1998 Hsu ..... D8/107
5,855,274 A 1/1999 Piao
D405,335 S 2/1999 Lin ..... D8/82
5,911,799 A 6/1999 Johnson et al. ..... 81/177.4
5,916,277 A 6/1999 Dallas ..... 7/128
5,916,341 A 6/1999 Lin
5,918,513 A 7/1999 Ho
5,918,741 A 7/1999 Vasudeva
5,938,028 A 8/1999 Hu
5,970,828 A 10/1999 Bondhus et al. ..... 81/440
D415,946 S 11/1999 Tsai ..... D8/107
5,983,759 A * 11/1999 Turner ..... 81/177.6
5,992,626 A 11/1999 Anderson ..... 206/378
D420,885 S 2/2000 Lin ..... D8/107
6,032,332 A 3/2000 Lin
D426,449 S 6/2000 Eklind ..... D8/107
D426,450 S 6/2000 Eklind ..... D8/107
D427,875 S 7/2000 Chiu ..... D8/105
6,085,620 A 7/2000 Anderson et al.
6,088,861 A 7/2000 Sessions et al.
6,089,133 A 7/2000 Liao
6,095,018 A 8/2000 Schuster
6,105,767 A 8/2000 Vasudeva
6,119,560 A 9/2000 Anderson et al. ..... 81/440
6,128,981 A 10/2000 Bondhus et al. ..... 81/440
D433,613 S 11/2000 Jialin
D433,910 S 11/2000 Oliver et al.
6,151,998 A 11/2000 Fu-Hui
D435,415 S 12/2000 Johnson et al. ..... D8/71
6,164,172 A 12/2000 Huang ..... 81/490
D435,773 S 1/2001 Lin ..... D8/83
D437,541 S 2/2001 Hermansen et al. ..... D8/105
D437,763 S 2/2001 Oliver et al.
6,186,785 B1 2/2001 Rogers et al.
6,202,864 B1 3/2001 Ernst et al.
6,206,189 B1 3/2001 Huot, Jr. et al.
D440,852 S 4/2001 Ernst
6,233,769 B1 5/2001 Seber et al. ..... 7/128
6,237,451 B1 5/2001 Wei
6,257,106 B1 7/2001 Anderson et al.
6,260,453 B1 7/2001 Anderson et al.
6,279,434 B1 8/2001 Brown
6,279,435 B1 8/2001 Zayat, Jr.
D448,267 S 9/2001 Jean et al. ..... D8/105
6,308,599 B1 10/2001 Fu-Hui
6,311,587 B1 11/2001 Johnson et al. ..... 81/177.4
6,314,838 B2 11/2001 Wall
6,318,218 B1 11/2001 Anderson et al.
6,332,381 B1 12/2001 Vasudeva
6,345,557 B1 2/2002 Kuo
D454,766 S 3/2002 Lin
6,357,068 B1 3/2002 Seber et al.
D455,630 S 4/2002 Chiu
6,382,057 B1 5/2002 Kienholz
6,389,931 B1 5/2002 Delaney et al.
6,397,709 B1 6/2002 Wall
6,401,576 B1 6/2002 Wu
6,405,620 B2 6/2002 Liao
D459,967 S 7/2002 Johnson et al. ..... D8/71
D461,311 S 8/2002 Gharib
D462,002 S 8/2002 Jean et al. ..... D8/105
6,427,564 B1 8/2002 Nelson
6,490,954 B2 12/2002 Johnson et al. ..... 81/177.4
6,510,766 B1 1/2003 Lin ..... 81/177.4
6,510,767 B1 1/2003 Rivera
D470,739 S 2/2003 Chen
D472,931 S 4/2003 Leins
6,564,680 B1 5/2003 Rinner et al.
6,598,503 B1 7/2003 Cunningham ..... 81/177.4
6,601,481 B2 8/2003 Chuang
D479,963 S 9/2003 Chang ..... D8/21
6,634,502 B1 10/2003 Yu
6,640,675 B1 11/2003 Chuang
6,675,678 B2 1/2004 Liu
6,698,318 B2 3/2004 Peters ..... 81/177.4
6,701,813 B2 3/2004 Hu
6,739,224 B1 5/2004 Wershe
6,751,819 B2 6/2004 Chuang ..... 7/100
6,751,820 B1 6/2004 Wu
6,752,046 B1 6/2004 Lee
6,758,350 B2 7/2004 Lin
6,763,744 B2 7/2004 Johnson et al. ..... 81/177.4
D494,438 S 8/2004 Falkenstein et al. ..... D8/105
6,799,490 B1 10/2004 Chu
6,877,186 B2 4/2005 Shiao
6,898,998 B2 5/2005 Shyu
6,901,826 B2 6/2005 Huang
6,918,323 B2 7/2005 Arnold et al.
6,922,870 B2 8/2005 Tontz, Sr.
6,925,910 B2 8/2005 Alford
6,928,908 B1 8/2005 Yu
6,935,211 B2 8/2005 Chen
6,941,843 B2 9/2005 Johnson et al. ..... 81/177.4
6,948,406 B1 9/2005 Li
6,968,758 B2 11/2005 Lin
D517,391 S 3/2006 Leins ..... D8/105
7,028,593 B1 4/2006 Lin et al.
7,047,847 B2 5/2006 Chuang
7,051,626 B1 5/2006 Chen
7,051,629 B2 5/2006 Huang
7,073,418 B2 7/2006 Kuo
7,080,582 B2 7/2006 Karle
7,086,314 B2 8/2006 Wannop
7,093,519 B1 8/2006 Huang
7,100,476 B1 9/2006 Feit
7,131,358 B2 11/2006 Hsien
7,140,280 B2 11/2006 Hawkins et al. ..... 81/440
7,143,669 B2 12/2006 Hu
7,150,208 B2 12/2006 Debley
7,159,260 B2 1/2007 Hansen
7,159,491 B1 1/2007 Chaconas et al.
7,165,479 B1 1/2007 Lee
7,168,345 B1 1/2007 Hsieh
7,182,003 B1 2/2007 Hsieh
7,185,565 B1 3/2007 Hu
7,216,569 B2 5/2007 Abdelgany
7,237,463 B1 7/2007 Lee
D548,464 S 8/2007 Lin
D549,069 S 8/2007 Lin et al. ..... D8/105
7,281,454 B2 10/2007 Johnson et al. ..... 81/177.4
7,284,466 B1 10/2007 Ho
D557,099 S 12/2007 Lin
7,305,908 B2 12/2007 Chi ..... 81/177.4
7,409,894 B1 8/2008 Valentine
7,467,574 B1 12/2008 Lin
7,467,575 B2 12/2008 Lai
7,565,852 B2 7/2009 Yu
7,600,640 B2 10/2009 Hallee et al.
D604,509 S 11/2009 Andrews
7,698,972 B2 4/2010 Hi
7,743,685 B2 6/2010 Chang
D622,125 S 8/2010 Robinson
D623,037 S 9/2010 Johnson et al.
7,810,415 B2 10/2010 Adamany et al.
7,836,534 B2 11/2010 Simmons
7,846,203 B2 12/2010 Cribier

(56) References Cited

U.S. PATENT DOCUMENTS

| | | | | |
|---|---|---|---|---|
| 7,946,203 | B2 | 5/2011 | Johnson et al. | |
| 8,011,277 | B2 | 9/2011 | Johnson et al. | |
| 8,015,642 | B1 | 9/2011 | Oakley | |
| D650,257 | S | 12/2011 | Royes et al. | |
| 8,336,428 | B2 | 12/2012 | Johnson et al. | |
| 8,613,121 | B1 | 12/2013 | White | |
| 8,640,574 | B2 | 2/2014 | Johnson et al. | |
| 2001/0005576 | A1 | 6/2001 | Rogers et al. | |
| 2001/0045145 | A1* | 11/2001 | Legg | 81/440 |
| 2003/0047474 | A1 | 3/2003 | Dahlson | |
| 2003/0126957 | A1 | 7/2003 | Huang | |
| 2003/0188610 | A1 | 10/2003 | Lin | |
| 2003/0226428 | A1 | 12/2003 | Liu | |
| 2004/0050218 | A1 | 3/2004 | Napoli | |
| 2004/0173061 | A1 | 9/2004 | Liou | |
| 2004/0262344 | A1 | 12/2004 | White | |
| 2005/0011318 | A1 | 1/2005 | Tsai | |
| 2005/0199108 | A1 | 9/2005 | Jheng | |
| 2005/0229752 | A1 | 10/2005 | Nickipuck | |
| 2005/0247587 | A1 | 11/2005 | Holland-Letz | |
| 2005/0268752 | A1 | 12/2005 | Johnson et al. | 81/177.4 |
| 2005/0268754 | A1 | 12/2005 | Fa | |
| 2005/0284267 | A1 | 12/2005 | Liao et al. | |
| 2006/0042428 | A1 | 3/2006 | Chuang | |
| 2006/0101955 | A1 | 5/2006 | Chang | 81/490 |
| 2006/0150784 | A1 | 7/2006 | Hsieh | |
| 2006/0213059 | A1 | 9/2006 | Eggert | 29/857 |
| 2006/0254396 | A1 | 11/2006 | Hu | |
| 2006/0288531 | A1 | 12/2006 | Hu | |
| 2006/0288823 | A1 | 12/2006 | Schepman | |
| 2007/0023306 | A1 | 2/2007 | Lai | |
| 2007/0044598 | A1 | 3/2007 | Frohm et al. | |
| 2007/0056117 | A1 | 3/2007 | Gardiner et al. | |
| 2007/0056872 | A1 | 3/2007 | Begim | |
| 2007/0151402 | A1 | 7/2007 | Schneeman et al. | |
| 2007/0221017 | A1* | 9/2007 | Heaven | 81/440 |
| 2007/0228672 | A1 | 10/2007 | Huang | |
| 2007/0245862 | A1 | 10/2007 | Gonzalez et al. | |
| 2007/0295171 | A1 | 12/2007 | Johnson et al. | |
| 2008/0148909 | A1 | 6/2008 | Lai | |
| 2008/0164171 | A1 | 7/2008 | Meng | |
| 2008/0190249 | A1 | 8/2008 | Yu | |
| 2008/0223179 | A1 | 9/2008 | Nash et al. | |
| 2008/0256816 | A1 | 10/2008 | Cosentino | |
| 2008/0271573 | A1 | 11/2008 | Lown et al. | |
| 2008/0295657 | A1 | 12/2008 | Cluthe | |
| 2009/0107303 | A1 | 4/2009 | Steinweg et al. | |
| 2009/0183608 | A1 | 7/2009 | Johnson et al. | |
| 2009/0183609 | A1 | 7/2009 | Johnson et al. | |
| 2009/0241740 | A1 | 10/2009 | Heagerty | |
| 2011/0000024 | A1 | 1/2011 | Johnson et al. | |
| 2012/0012485 | A1 | 1/2012 | Wang | |

FOREIGN PATENT DOCUMENTS

| | | | | |
|---|---|---|---|---|
| CN | 2628230 | Y | 7/2004 | |
| DE | 464002 | | 8/1928 | |
| DE | 24 53 480 | A1 | 5/1976 | B25B 13/54 |
| DE | 37 44 176 | A1 | 8/1989 | B25F 1/00 |
| DE | 102004011892 | | 1/2005 | |
| EP | 503 559 | A1 | 9/1992 | B25B 27/00 |
| EP | 618 046 | A1 | 10/1994 | B25B 13/56 |
| EP | 01693163 | | 2/2006 | |
| EP | 01777042 | | 4/2007 | |
| FR | 787512 | | 9/1935 | |
| GB | 856223 | | 12/1960 | B25B 61/00 |
| JP | 55-045442 | U | 3/1980 | B25B 13/56 |
| JP | 57-13165 | | 1/1982 | B25B 13/54 |
| JP | 61136778 | | 6/1986 | |
| JP | 3-47775 | | 5/1991 | B25B 13/54 |
| JP | 03103162 | | 10/1991 | |
| JP | 4-29368 | | 3/1992 | B25B 23/00 |
| JP | 5-31882 | | 4/1993 | |
| JP | 08505812 | | 6/1996 | |
| WO | WO 83/01406 | | 4/1983 | B25G 1/08 |
| WO | 9412322 | A1 | 6/1994 | |
| WO | 9623631 | | 8/1996 | |
| WO | WO 97/29887 | | 8/1997 | B25F 1/04 |

* cited by examiner

RADIAL FOLDOUT TOOL

FIELD OF THE INVENTION

The present invention relates to the field of hand held tools. More specifically, the present invention relates to the field of hexagonal wrenches and related tools and safety, comfort, and convenience of accessories and tools.

BACKGROUND OF THE INVENTION

Hexagonal wrenches or tool drivers, also referred to as allen wrenches or L-wrenches, have a hexagonal L-shaped body, including a long leg member and a short leg member. The end of either leg member is able to be inserted into a head of a screw or tool designed to accept a hexagonal wrench. Once inserted, rotational pressure is applied to the hexagonal wrench in order to tighten or loosen the screw. The leg members of the hexagonal wrench are designed to be of different lengths in order to allow a user flexibility when using the wrench in different environments and situations. For example, in a narrow, confined environment, the long leg of the hexagonal wrench is inserted into the head of the screw and the user will apply rotational pressure to the short leg. Or, if the environment is not so confined, the user is able to insert the short leg of the hexagonal wrench into the head of the screw and apply rotational pressure to the long leg.

Hexagonal wrenches are manufactured and distributed in multiple English and metric sizes in order to facilitate their use with screw heads of multiple sizes. Such wrenches are usually sold in a set which includes wrenches of multiple sizes but are also distributed individually.

When using a hexagonal wrench, a user, will insert an end of the hexagonal wrench into the head of a workpiece such as a screw, and will then exert rotational pressure on the opposite end of the wrench in order to tighten or loosen the screw. Because of the size and dimensions of the hexagonal wrench it is particularly difficult to exert a great amount of rotational pressure on the hexagonal wrench when the long leg of the hexagonal wrench is inserted into the head of the screw. Because the hexagonal wrench is typically turned with the user's fingers, the user is able to also experience scrapes and cuts from the use of hexagonal wrenches in this manner. Ingenuitive users have also used other tools, including vice grips, pliers and the like, to turn hexagonal wrenches. However, this method is disadvantageous because such tools are able to lose their hold on the hexagonal wrench when rotational pressure is applied or are able to even bend or otherwise disfigure the hexagonal wrench.

SUMMARY OF THE INVENTION

A radial foldout tool includes a body with opposing ends and one or more sets of tool drivers. A first set of tool drivers are positioned on/near a first end and a second set of tool drivers are positioned on/near a second end. The tool drivers are contained within channels of the body when in a closed position. The tool drivers are also contained in a plurality of planes. The tool drivers open by rotating/moving in a direction at least perpendicular to a neighboring tool driver. When they are in an open position, each of the tool drivers are in/near the center of the end of the body. By being positioned in/near the center of the end, the radial foldout tool is able to be gripped and turned in a fashion similar to a standard screwdriver.

In one aspect, a device comprises a body having a center, a first end and a second end, wherein the first end and the second end are positioned on opposite ends of the body and a first set of tool drivers positioned within the body in a plurality of planes, wherein each tool driver of the first set of tool drivers is configured to be positioned generally in the center out of the first end in an open position. The device further comprises a second set of tool drivers positioned within the body in the plurality of planes, wherein the second set of tool drivers are configured to be positioned out of the second end. The first set of tool drivers and the second set of tool drivers are positioned within the body in a closed position. Each tool driver of the second set of tool drivers is positioned out of the second end in an open position. Each tool driver of the second set of tool drivers is positioned generally in the center of the second end in an open position. In some embodiments, a first tool driver of the first set of tool drivers is in the same plane as a second tool driver of the second set of tool drivers. The body includes a set of channels for the first set of tool drivers and the second set of tool drivers to be positioned in the closed position. In some embodiments, each tool driver of the first set of tool drivers is positioned at least 90° around the circumference of the first end away from a neighboring tool driver and each tool driver of the second set of tool drivers is positioned at least 90° around the circumference of the second end away from a neighboring tool driver. The body is generally cylindrical. In some embodiments, the first set of tool drivers and the second set of tool drivers are selected from the group consisting of hexagonal wrenches, screwdrivers, socket wrenches and star-shaped drivers. In some embodiments, the first set of tool drivers are hexagonal wrenches and the second set of tool drivers are screwdrivers. The device further comprises a stop within the body for preventing each of the first set of tool drivers from opening further.

In another aspect, a device comprises a body having a center, the body including a plurality of faces, a first end and a second end, wherein the first end and the second end are positioned on opposite ends of the body, a first set of tool drivers, each tool driver of the first set of tool drivers positioned within the body on a face of the plurality of faces, wherein the first set of tool drivers are configured to be positioned generally in the center out of the first end in an open position and a second set of tool drivers, each tool driver of the second set of tool drivers positioned on a face of the plurality of faces within the body, wherein the first set of tool drivers are configured to be positioned generally in the center out of the second end in an open position. The first set of tool drivers and the second set of tool drivers are positioned within the body in a closed position. In some embodiments, a first tool driver of the first set of tool drivers is in the same plane as a second tool driver of the second set of tool drivers. The body includes a set of channels for the first set of tool drivers and the second set of tool drivers to be positioned in the closed position. Each tool driver of the first set of tool drivers and the second set of tool drivers is positioned in the open position by rotation in a substantially perpendicular direction away from the face. The body is generally cylindrical. In some embodiments, the first set of tool drivers and the second set of tool drivers are selected from the group consisting of hexagonal wrenches, screwdrivers, socket wrenches and star-shaped drivers. In some embodiments, the first set of tool drivers are hexagonal wrenches and the second set of tool drivers are screwdrivers. The device further comprises a stop within the body for preventing each of the first set of tool drivers and the second set of tool drivers from opening further.

In yet another aspect, a generally cylindrical tool handle having a body with a center, a first end and a second end and a generally cylindrical surface, the handle including a plurality of tool drivers each of a differing size in a plurality of planes, wherein each of the plurality of tool drivers includes an elongated rod coupled with the tool handle having a bend through a predetermined angle and including a proximal end for engaging an object, and a mounting end between the bend and a distal end, further wherein each tool driver of the set of tool drivers is positioned generally in the center of one of the first end and the second end in an open position. The set of tool drivers are positioned within the body in a closed position. In some embodiments, each tool driver of the set of tool drivers is positioned at least 90° around the circumference of one of the first end and the second end away from a neighboring tool driver. The tool handle further comprises a stop within the body for preventing each tool driver of the set of tool drivers from opening further.

DETAILED DESCRIPTION OF THE PREFERRED EMBODIMENT

A radial foldout tool stores tool drivers in a compact configuration. The tool drivers are able to be positioned for use to tighten or loosen an object such as a screw or bolt.

Figure 1:
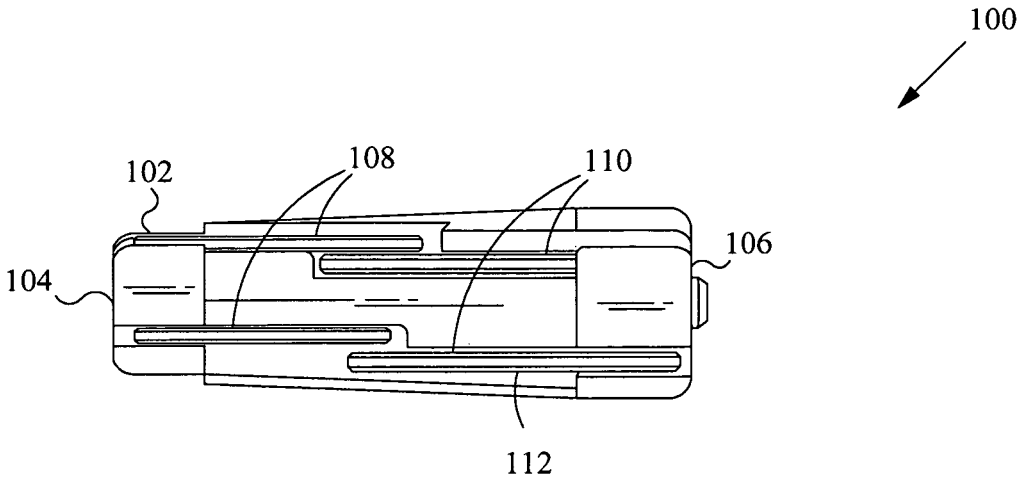
FIG. 1 illustrates an isometric view of a radial foldout tool in a closed position in accordance with the apparatus of the present invention.

FIG. 1 illustrates an isometric view of a radial foldout tool 100 in a closed position in accordance with the apparatus of the present invention. A first set of tool drivers 108 are coupled to or near a first end 104 of a body 102 of the radial foldout tool 100. Each tool driver 112 of the first set of tool drivers 108 is coupled so that it is able to rotate out to an open position. In some embodiments, when each of the first set of tool drivers 108 are stored in a closed position, they fit securely within channels of the body 102. A second set of tool drivers 110 are coupled to or near a second end 106 of the body 102 of the radial foldout tool 100. Each tool driver 112 of the second set of tool drivers 110 is coupled so that it is able to rotate out to an open position. In some embodiments, when each of the second set of tool drivers 110 are stored in a closed position, they fit securely within channels of the body 102.

In some embodiments, each of the tool drivers 112 of the first set of tool drivers 108 are positioned in the body 102 in a different plane from the other tool drivers of the first set of tool drivers 108. Similarly, in some embodiments, each of the tool drivers 112 of the second set of tool drivers 110 are positioned in the body 102 in a different plane from the other tool drivers of the second set of tool drivers 110. For example, in a radial foldout tool 100 which has a body 102 that is generally cylindrical in shape and surface, a first tool driver is positioned at 0 degrees along the circumference of a round first end of the tool, a second tool driver is positioned at 120 degrees along the circumference and a third tool driver is positioned at 240 degrees along the circumference. Tool drivers are similarly positioned on the opposite end as well.

In some embodiments, each tool driver of the first set of tool drivers 108 is positioned in the same plane as a correspondingly positioned tool driver of the second set of tool drivers 110.

In some embodiments, each of the tool drivers of the radial foldout tool 100 is configured to open at least perpendicularly to its neighboring tool driver. For example, with a radial foldout tool 100 containing three tool drivers at each end, a first tool driver opens at 0 degrees, a second tool driver opens at 90 degrees and a third tool driver opens at 270 degrees. This configuration enables each of the tool drivers to open into/near the middle/center of the end, so that a user has better and easier turning power instead of the awkward turning capabilities when the tool drivers are not positioned near the middle of the end.

In some embodiments, a hard stop such as an internal wall prevents the tool drivers from opening past a certain angle such as 180° so that the tool extends perpendicular to the corresponding end.

Figure 2:
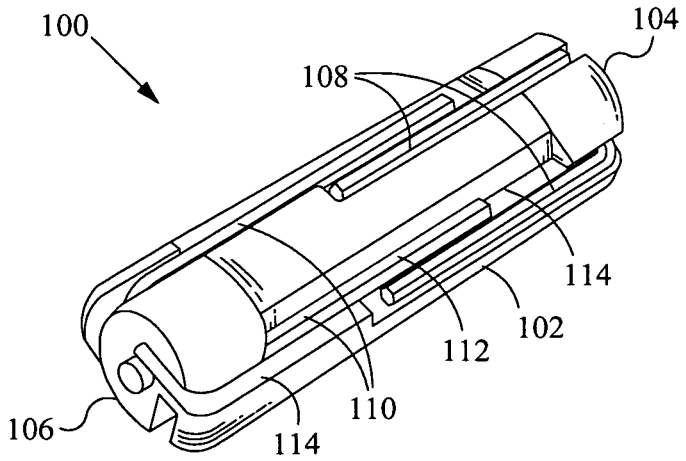
FIG. 2 illustrates a perspective view of a radial foldout tool in a closed position in accordance with the apparatus of the present invention.

FIG. 2 illustrates a perspective view of a radial foldout tool 100 in a closed position in accordance with the apparatus of the present invention. A first set of tool drivers 108 are coupled to or near a first end 104 of a body 102 of the radial foldout tool 100. The first set of tool drivers 108 are coupled so that they are able to rotate out to an open position. In some embodiments, when each of the first set of tool drivers 108 are stored in a closed position, they fit securely within channels 114 of the body 102. A second set of tool drivers 110 are coupled to or near a second end 106 of the body 102 of the radial foldout tool 100. The second set of tool drivers 110 are coupled so that they are able to rotate out to an open position. In some embodiments, when each of the second set of tool drivers 110 are stored in a closed position, they fit securely within channels 114 of the body 102.

Figure 3:
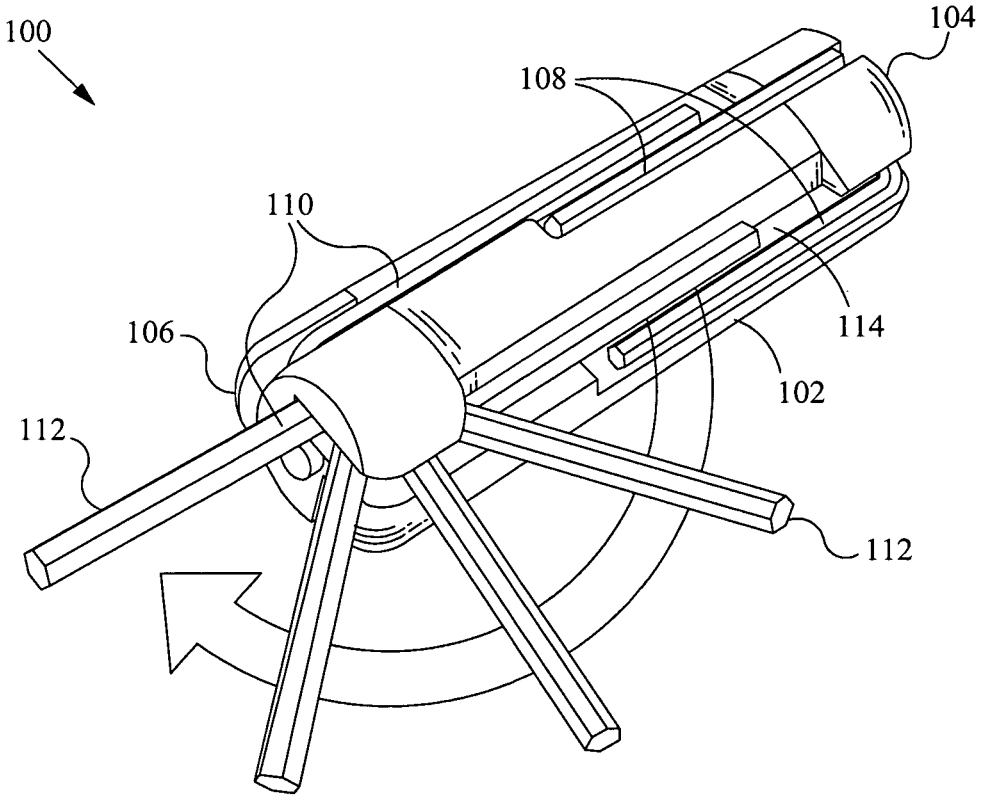
FIG. 3 illustrates a perspective view of a radial foldout tool with a tool driver moving from a closed position to an open position in accordance with the apparatus of the present invention.

FIG. 3 illustrates a perspective view of a radial foldout tool 100 with a tool driver moving from a closed position to an open position in accordance with the apparatus of the present invention. When positioned in a closed position, the tool driver 112 is stored within a channel 114, in some embodiments. A user is able to rotate the tool driver 112 to an open position as shown. In some embodiments, the tool driver 112 is limited in the direction it is able to rotate, such that it rotates away from the channel in which it is stored. Furthermore, the tool driver's rotational range is limited so that the tool driver 112 stops rotating once it is pointing in a parallel direction to the body 102. In an open position, the tool driver 112 is also generally in the middle of the of the end of the body 102. To position the tool driver 112 in a closed position, a user rotates the tool driver 112 in an opposite direction from the opening direction so that the tool driver 112 rests within the channel 114, in some embodiments.

Figure 4:
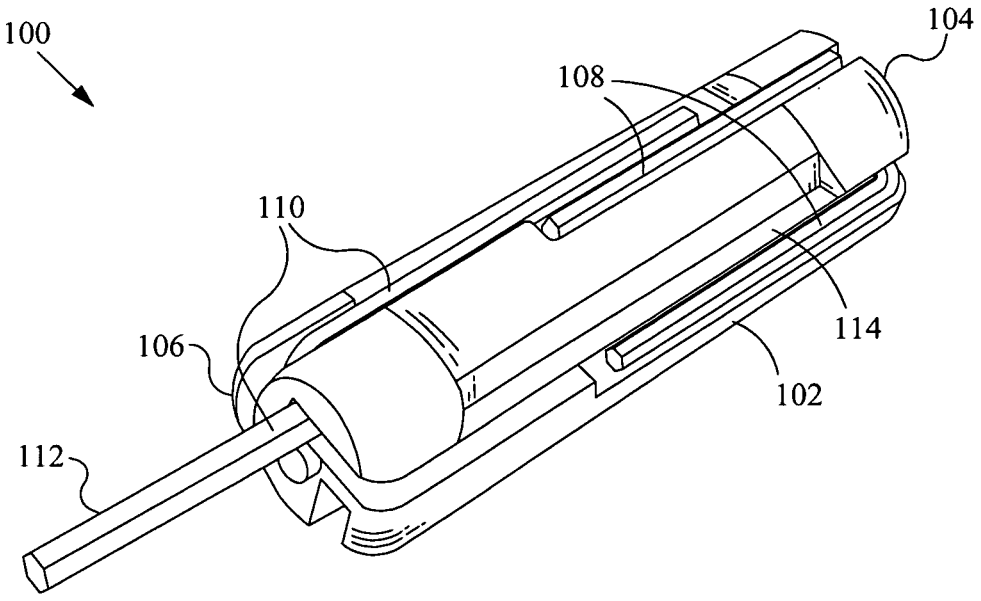
FIG. 4 illustrates a perspective view of a radial foldout tool in an open position in accordance with the apparatus of the present invention.

FIG. 4 illustrates a perspective view of a radial foldout tool 100 in an open position in accordance with the apparatus of the present invention. When in an open position, a tool driver 112 is positioned pointing in a parallel direction to the body 102 and generally in the middle of the end of the body 102, in some embodiments. This enables users to grip the body 102 as a handle and use the radial foldout tool 100 similarly to a screw driver or other tool that has a body with a tool driver protruding out of the middle of the handle. The radial foldout tool 100 is intended to be used with one of the tool drivers 112 in an open position. While one of the tool drivers 112 is in an open position, the other tool drivers 112 are in a closed position.

Figure 5:
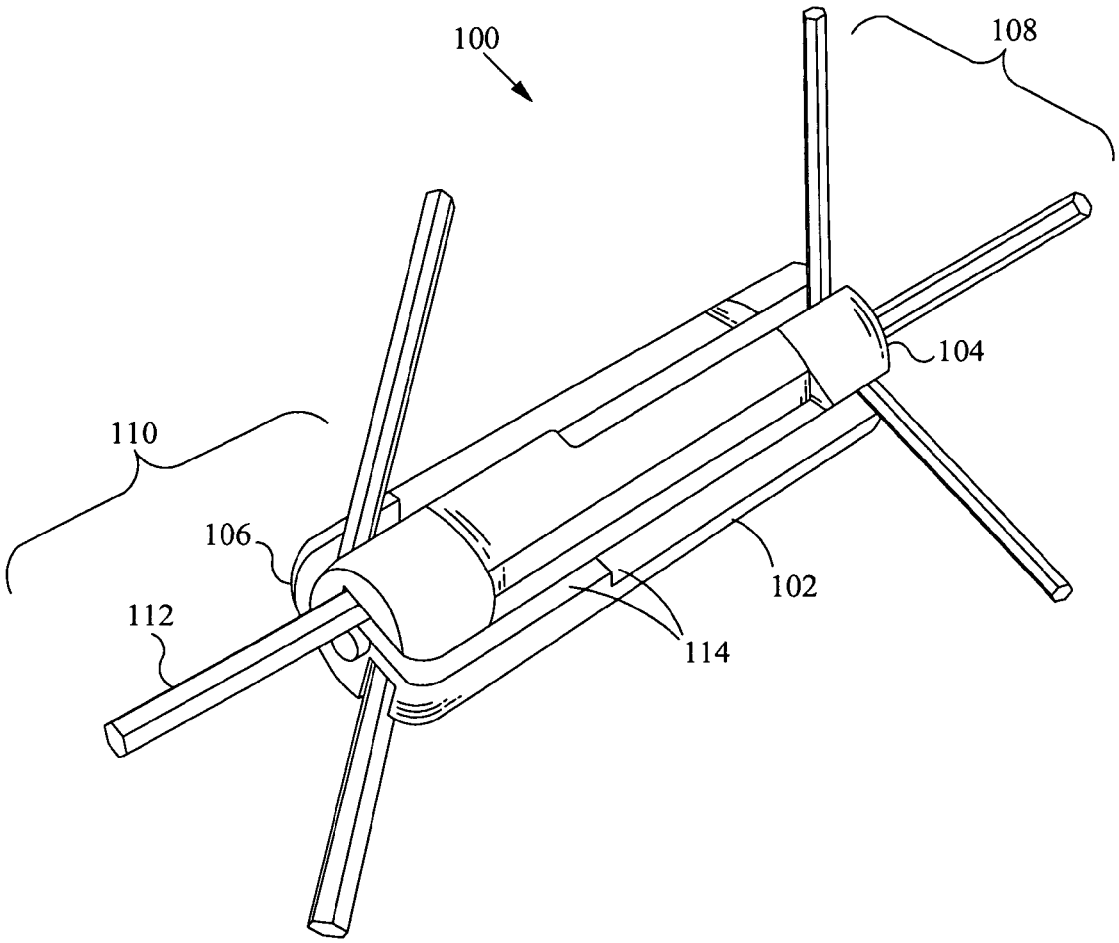
FIG. 5 illustrates a perspective view of a radial foldout tool with all of the tool drivers in an open or partially open position in accordance with the apparatus of the present invention.

FIG. 5 illustrates a perspective view of a radial foldout tool 100 with all of the tool drivers in an open or partially open position in accordance with the apparatus of the present invention. The drawing of FIG. 5 is for illustration purposes only. When in use the radial foldout tool 100 is designed to work with one tool driver open at a time.

In some embodiments, the radial foldout tool 100 is designed to include some hexagonal wrenches of English sizes including a 9/32 inch hexagonal wrench, a 1/4 inch hexagonal wrench, a 7/32 inch hexagonal wrench, a 3/16 inch hexagonal wrench, a 5/32 inch hexagonal wrench, a 9/64 inch hexagonal wrench, a 1/8 inch hexagonal wrench, a 7/64 inch hexagonal wrench, a 3/32 inch hexagonal wrench and a 5/64 inch hexagonal wrench.

In some embodiments, the radial foldout tool 100 is designed to include some hexagonal wrenches of metric sizes including a 10 mm hexagonal wrench, an 8 mm hexagonal wrench, a 6 mm hexagonal wrench, a 5 mm hexagonal wrench, a 4.5 mm hexagonal wrench, a 4 mm hexagonal wrench, a 3.5 mm hexagonal wrench, a 3 mm hexagonal wrench, a 2.5 mm hexagonal wrench and a 2 mm hexagonal wrench. It should be apparent to one skilled in the art that a radial foldout tool 100 is able to be formed to hold fewer, additional or different sizes of hexagonal wrenches.

In some embodiments, the radial foldout tool 100 is designed to be of a round shape. In some embodiments, the radial foldout tool 100 is designed to be of a triangular shape including three faces, a square or rectangle shape including four faces, a hexagonal shape including six faces or any other appropriate shape. In some embodiments, a single tool driver is positioned on each face of the radial foldout tool 100. In some embodiments, each face is approximately 1 inch across its width and the body 102 of the radial foldout tool 100 is approximately 4.5 inches in length. The body 102 is designed to provide a comfortable, user-friendly interface to a user's hand, in order to enhance a user's ability to exert rotational pressure on the tool driver 112 without subjecting the user to personal injury or requiring the use of additional tools. As should be apparent to one skilled in the art, the body 102 of the present invention may be designed to be of any convenient shape, including any number of faces.

The body 102 of the radial foldout tool 100 is able to be composed of any appropriate material, which is of maximum strength and includes properties which resist materials that the handle will likely be exposed to, e.g., oil, grease, gasoline and the like. In some embodiments, the body 102 is materially composed of 30% glass-filled polycarbonate. In some embodiments, the body 102 is materially composed of any suitable composition including, but not limited to aluminum or steel. In some embodiments, the tool drivers 112 are materially composed of aluminum, steel or any other appropriate material.

In some embodiments, the body 102 is constructed using an injection molded, core/cavity process as is well known in the art. Alternatively, the body 102 may be constructed in any known manner.

Figure 6A:
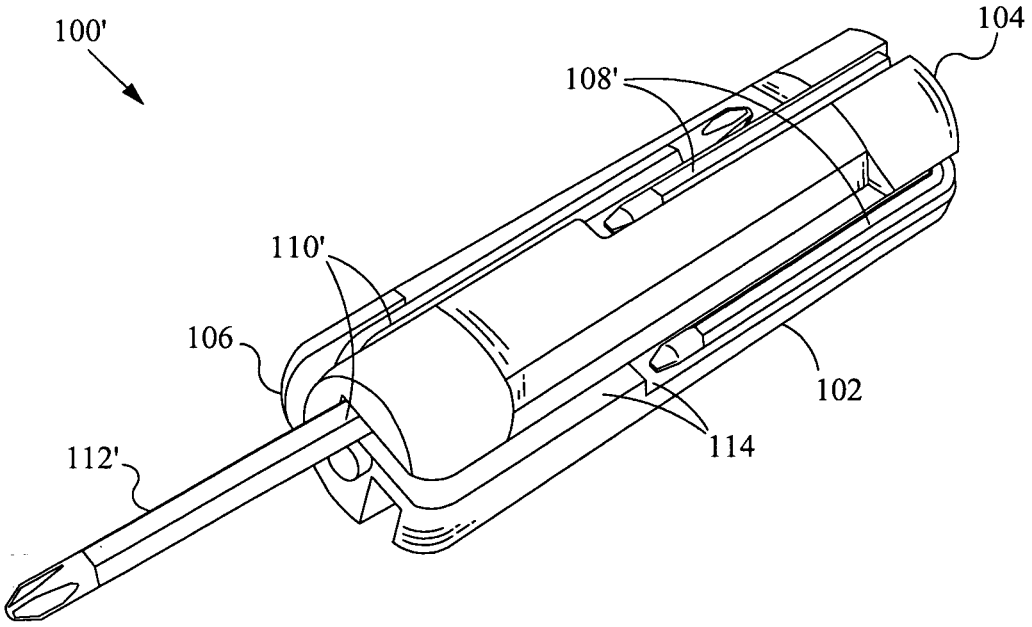
FIG. 6A illustrates a perspective view of a radial foldout tool with alternative tool drivers in accordance with the apparatus of the present invention.
Figure 6B:
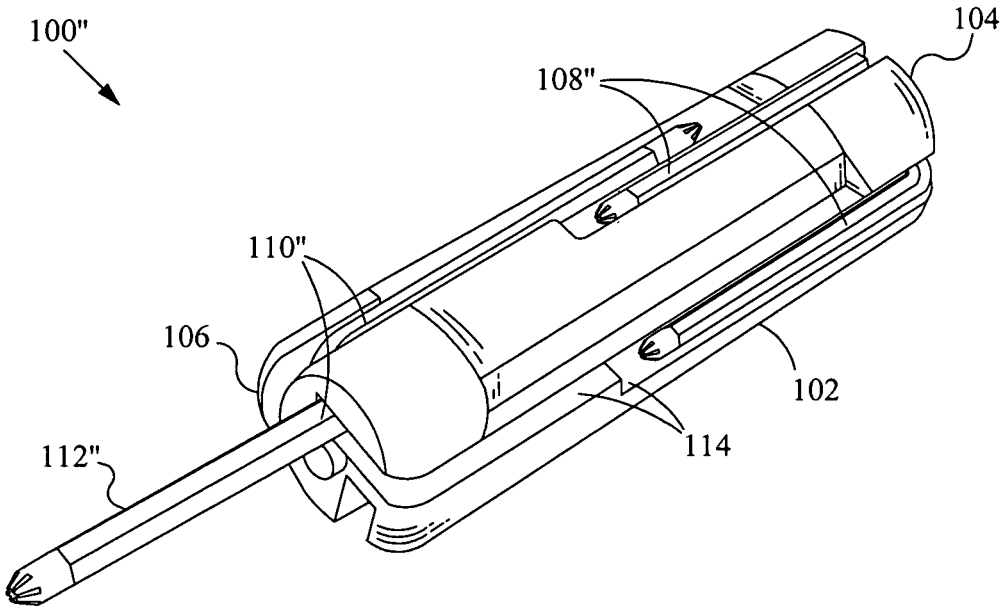
FIG. 6B illustrates a perspective view of a radial foldout tool with alternative tool drivers in accordance with the apparatus of the present invention.
Figure 6C:
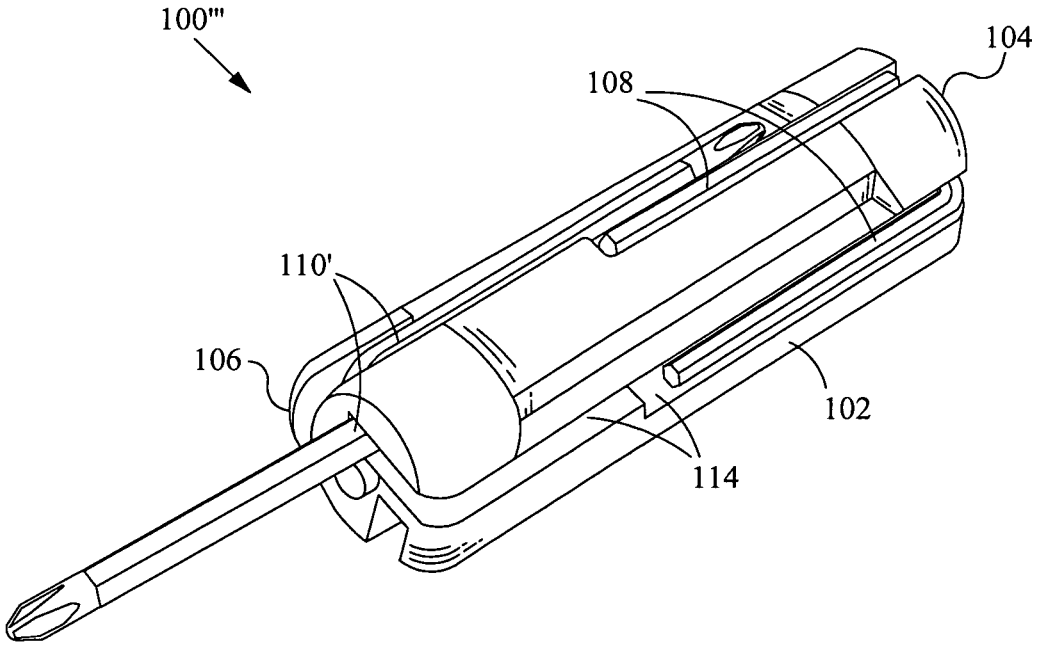
FIG. 6C illustrates a perspective view of a radial foldout tool with alternative tool drivers in accordance with the apparatus of the present invention.

FIGS. 6A, 6B and 6C each illustrate a perspective view of a radial foldout tool with alternative tool drivers.

FIG. 6A illustrates a radial foldout tool 100' with screwdrivers as tool drivers 112'. The body 102 is similar to or the same as embodiments above with two opposing ends 104 and 106. Additionally, the channels 114 are also similar to or the same as embodiments above. However, in this embodiment, a first set of tool drivers 108' includes flat head screwdrivers, and the second set of tool drivers 110' includes phillips head screwdrivers. In some embodiments, the sizes and/or shapes of the heads of the screwdrivers vary. For example, the sizes of the screwdriver heads are able to vary to small enough for use with a tiny screw for securing eyeglass components together up to much larger screws. Also, for varying shapes, at times a more pointed screwdriver is necessary for a screw while other times a flatter screwdriver is necessary or preferred. The thickness of the screwdriver tip varies, in some embodiments. In some embodiments, the first set and the second set of tool drivers are all flat head screwdrivers or phillips head screwdrivers. Any variations of screwdrivers are possible.

FIG. 6B illustrates a radial foldout tool 100" with star-shaped drivers as tool drivers 112'. As described above in reference to FIG. 6A, the body 102 with two opposing ends 104 and 106 is similar to or the same as well as the channels 114 for previous embodiments. However, in this embodiment, the first and second sets of tool drivers 108" and 110" are star-shaped drivers. The stars-shaped drivers vary in size, thickness and/or any other characteristic.

FIG. 6C illustrates a radial foldout tool 100'" with both screwdrivers and hexagonal wrenches as tool drivers. Again, the body 102 with two opposing ends 104 and 106 and the channels 114 are similar to or the same as in previous embodiments. However, instead of simply having one type of tool driver, such as hexagonal wrenches, multiple sets of tool drivers are included such as hexagonal wrenches and screwdrivers. In the embodiment shown, a first set of tool drivers 108 includes hexagonal wrenches and a second set of tool drivers 110' includes screwdrivers. Furthermore, the screwdrivers are able to be one type of screwdriver with varying shapes and sizes, and/or are able to include multiple types of screwdrivers such as flat heads and phillips head screwdrivers. While an example of a radial foldout tool with screwdrivers and hexagonal wrenches has been shown, other types of combination tools are possible such as screwdrivers and star-shaped drivers, hexagonal wrenches and star-shaped drivers, hexagonal wrenches and socket wrenches, combinations of three or more tool drivers or any other combinations of tool drivers.

Figure 7:
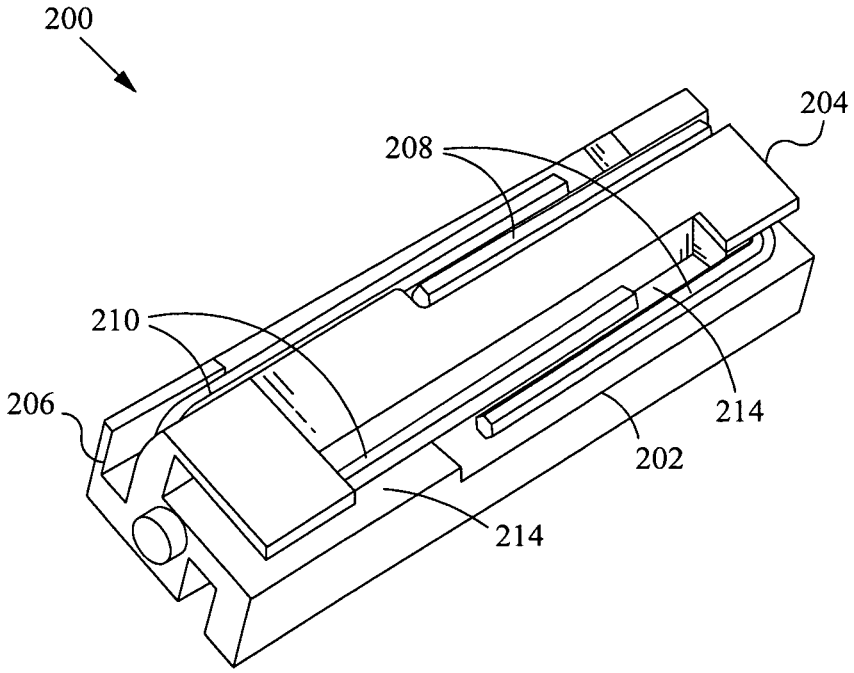
FIG. 7 illustrates a perspective view of a radial foldout tool with a plurality of faces in a closed position in accordance with the apparatus of the present invention.

FIG. 7 illustrates a perspective view of a radial foldout tool 200 with a plurality of faces in a closed position in accordance with the apparatus of the present invention. A first set of tool drivers 208 are coupled to or near a first end 204 of a body 202 of the radial foldout tool 200. The first set of tool drivers 208 are coupled so that they are able to rotate out to an open position. In some embodiments, when each of the first set of tool drivers 208 are stored in a closed position, they fit securely within channels 214 of the body 202. A second set of tool drivers 210 are coupled to or near a second end 206 of the body 202 of the radial foldout tool 200. The second set of tool drivers 210 are coupled so that they are able to rotate out to an open position. In some embodiments, when each of the second set of tool drivers 210 are stored in a closed position, they fit securely within channels 214 of the body 202. In some embodiments, some of the faces contain a tool driver. In some embodiments, each of the faces contain a single tool driver, and in other embodiments, each of the faces contain at least one tool driver.

To utilize a radial foldout tool, a user moves a desired tool driver from a closed position to an open position. The user moves the desired tool driver using a finger or two to simply pull or push the tool driver in the appropriate direction. In some embodiments, the tool driver locks into place in the open position. The user then grasps the body of the radial foldout tool similarly to grasping a handle of a screwdriver. The user turns the body of the radial foldout tool to either tighten or loosen an object such as a screw or bolt. This turning action is also similar to the use of a screwdriver. Once the user has performed the tightening or loosening actions on the desired object or objects, the tool driver is moved to a closed position by pushing or pulling the tool driver with the user's fingers. In some embodiments, the tool drivers lock in the closed position. When in the closed position, the tools are safely stored within channels in the body to prevent injuries. Unlike a standard screwdriver which has a sharp point jutting out of the handle, the radial foldout tool is able to be compacted and stored safely.

In operation, a radial foldout tool contains multiple tool drivers to consolidate the space needed for a set of tool drivers. Furthermore, the body of the radial foldout tool contains channels for storing the tool drivers in a closed position, so that more tools are able to be stored. The tool drivers are all configured to rotate to an open position which is generally in the middle/center of each end of the body of the radial foldout tool. By being near the middle of each end, turning the radial foldout tool is more stable for a user when the radial foldout tool is in use and each of the tool drivers are in use. The tool drivers are also stored in a plurality of planes in the body which help ensure the tool drivers open to the middle of each end. Since the tool drivers are stored in a plurality of planes, the tool drivers open in a direction at least perpendicular to their neighboring tool driver to further ensure they open to the middle of each end of the radial foldout tool. Previously existing foldout tools suffer from an awkward grasping implementation where the awkwardness is due to the fact that, in the worst case, for example, the previously existing tools allow for the smallest of wrenches to place the part of the tool that is grasped and turned, as far off-axis as possible (and without the benefit of a hard stop in the fully extended position as the present radial foldout tool does). In addition to that, since the previously existing tools are rectangular cubes, the user's hand is required to either fully disengage the tool between turns, or to use rather involved spider-like, alternating stepping actions with the fingers to crawl the hand around the tool into position for the next twist, all the while, keeping the tool stabilized in multiple axes due to the fact that the grasp is compromised and that the wrench, when fully extended, is able to rotate at least 270°. Whereas, with the present radial foldout tool design, the user's hand is able to simply loosen the grasp and slide the palm around within the circumference of the tool while maintaining a steady and sure grasp on the tool, wrench and fastener.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the appended claims.

What is claimed is:

1. A device comprising:

a. a generally cylindrical body having a center, a first round end and a second round end, wherein the first end and the second end are positioned on opposite ends of the body;

b. a first set of tool drivers positioned within the body in a plurality of planes, wherein each tool driver of the first set of tool drivers is configured to be positioned out of the first round end in an open position, wherein each tool driver is prevented from opening past an angle of 180 degrees and all of each tool driver of the first set of tool drivers that extends outward from the body, extends parallel to, and offset from the central longitudinal axis of the body of the device when placed in the open position; and c. a second set of tool drivers positioned within the body in the plurality of planes, wherein the second set of tool drivers are configured to be positioned out of the second end, wherein at least one tool driver of the first set of the tool drivers and one tool driver of the second set of tool drivers is positioned in a first channel and at least one tool driver of the first set of the tool drivers and one tool driver of the second set of tool drivers is positioned in a second channel, each of the first channel and the second channel comprising a first side, a second side and a bottom and further wherein a plurality of tool drivers in the first set of tool drivers are capable of being placed in the open position at the same time.

2. The device of claim 1 wherein the first set of tool drivers and the second set of tool drivers are positioned within the body in a closed position.

3. The device of claim 1 wherein each tool driver of the second set of tool drivers is positioned out of the second end in an open position.

4. The device of claim 1 wherein each tool driver of the second set of tool drivers is positioned generally in the center of the second end in an open position.

5. The device of claim 1 wherein a first tool driver of the first set of tool drivers is in the same plane as a second tool driver of the second set of tool drivers.

6. The device of claim 2 wherein the body includes a set of channels for the first set of tool drivers and the second set of tool drivers to be positioned in the closed position.

7. The device of claim 1 wherein each tool driver of the first set of tool drivers is positioned at least 90° around the circumference of the first end away from a neighboring tool driver of the first set and each tool driver of the second set of tool drivers is positioned at least 90° around the circumference of the second end away from a neighboring tool driver of the second set and each tool driver of the set.

8. The device of claim 1 wherein the first set of tool drivers and the second set of tool drivers are selected from the group consisting of hexagonal wrenches, screwdrivers, socket wrenches and star-shaped drivers.

9. The device of claim 1 wherein each tool driver of the first set of tool drivers is a different tool driver.

10. The device of claim 1 further comprising a stop within the body for preventing each of the first set of tool drivers from opening further than 180° .

11. A device comprising:

a. a generally cylindrical body having a center, the body including:

i. a plurality of planes;

ii. a first round end; and iii. a second round end, wherein the first end and the second end are positioned on opposite ends of the body;

b. a first set of tool drivers, wherein each tool driver is prevented from opening past an angle of 180 degrees and wherein all of each tool driver of the first set of tool drivers that extends outward from the body, extends parallel to, and offset from the central longitudinal axis of the body of the device when placed in an open position and further wherein the first set of tool drivers are configured to be positioned out of the first round end in the open position; and c. a second set of tool drivers, wherein each tool driver is prevented from opening past an angle of 180 degrees and wherein all of each tool driver of the second set of tool drivers that extends outward from the body, extends parallel to, and offset from the central longitudinal axis of the body of the device when placed in an open position and further wherein the first set of tool drivers are configured to be positioned out of the second round end in the open position, wherein at least one tool driver of the first set of the tool drivers and one tool driver of the second set of tool drivers is positioned in a first channel and at least one tool driver of the first set of the tool drivers and one tool driver of the second set of tool drivers is positioned in a second channel, each of the first channel and the second channel comprising a first side, a second side and a bottom and further wherein a plurality of tool drivers in the first set of tool drivers are capable of being placed in the open position at the same time.

12. The device of claim 11 wherein the first set of tool drivers and the second set of tool drivers are positioned within the body in a closed position.

13. The device of claim 11 wherein a first tool driver of the first set of tool drivers is in the same plane as a second tool driver of the second set of tool drivers.

14. The device of claim 12 wherein the body includes a set of channels for the first set of tool drivers and the second set of tool drivers to be positioned in the closed position.

15. The device of claim 13 wherein each tool driver of the first set of tool drivers and the second set of tool drivers is positioned in the open position by rotation in a direction away from the first plane and the second plane, respectively.

16. The device of claim 11 wherein the first set of tool drivers and the second set of tool drivers are selected from the group consisting of hexagonal wrenches, screwdrivers, socket wrenches and star-shaped drivers.

17. The device of claim 11 wherein each tool driver of the first set of tool drivers is a different tool driver.

18. The device of claim 11 further comprising a stop within the body for preventing each of the first set of tool drivers and the second set of tool drivers from opening further than 180° .

19. A generally cylindrical tool handle having a body with a center, a first round end and a second round end and a generally cylindrical surface, the handle including a plurality of tool drivers each of a differing size in a plurality of planes, wherein each of the plurality of tool drivers comprises a continuously linear portion coupled with the tool handle and including a proximal end for engaging an object wherein each tool driver is prevented from opening past an angle of 180 degrees and further wherein each tool driver is positioned out of one of the first round end and the round second end in an open position, wherein all of each tool driver that extends outward from the body, extends parallel to, and offset from the central longitudinal axis of the body of the tool handle when placed in the open position, and wherein a plurality of the tool drivers are positioned in a first channel and at least a plurality of the tool drivers are positioned in a second channel, each of the first channel and the second channel comprising a first side, a second side and a bottom and further wherein a plurality of tool drivers in the first set of tool drivers are capable of being placed in the open position at the same time.

20. The tool handle of claim 19 wherein the set of tool drivers are positioned within the body in a closed position.

21. The tool handle of claim 19 wherein each tool driver of the set of tool drivers is positioned at least 90° around the circumference of one of the first end and the second end away from a neighboring tool driver.

22. The tool handle of claim 19 further comprising a stop within the body for preventing each tool driver of the set of tool drivers from opening further.

23. A device comprising:

a. a generally cylindrical body having a center, a first end and a second end, wherein the first end and the second end are positioned on opposite ends of the body;

b. a first set of tool drivers positioned within the body in a plurality of planes, wherein each tool driver of the first set of tool drivers is positioned out out of the first end in an open position and wherein all of each tool driver that extends outward from the body, extends parallel to, and offset from the central longitudinal axis of the body of the device when placed in the open position and further wherein each tool driver of the first set of tool drivers is lockable into place in the open position; and c. a second set of tool drivers positioned within the body in the plurality of planes, wherein the second set of tool drivers are configured to be positioned out of the second end, wherein at least one tool driver of the first set of the tool drivers and one tool driver of the second set of tool drivers is positioned in a first channel and at least one tool driver of the first set of the tool drivers and one tool driver of the second set of tool drivers is positioned in a second channel, each of the first channel and the second channel comprising a first side, a second side and a bottom and further wherein a plurality of tool drivers in the first set of tool drivers are capable of being placed in the open position at the same time.

24. A device comprising:

a. a generally cylindrical body having:

i. a center;

ii. a first end;

iii. a second end, wherein the first end and the second end are positioned on opposite ends of the body; and iv. a plurality of channels positioned in a plurality of planes around an outside of the generally cylindrical body, each of the channels having a first channel portion and a second channel portion, wherein the first channel portion is at an approximately 90° angle to the second channel portion;

b. a first set of tool drivers each positioned within one of the plurality of channels, wherein each tool driver of the first set of tool drivers has a first tool portion, a second tool portion and a bend between the first tool portion and the second tool portion, wherein when each tool driver is in a closed position, the first tool portion is in the first channel portion and the second tool portion is in the second channel portion, and further wherein each tool driver is positioned out of the first end in an open position and wherein all of each tool driver that extends outward from the body, extends parallel to, and offset from the central longitudinal axis of the body of the device when placed in the open position; and c. a second set of tool drivers each positioned within one of the plurality of channels, wherein the second set of tool drivers are configured to be positioned out of the second end, wherein at least one tool driver of the first set of the tool drivers and one tool driver of the second set of tool drivers is positioned in a first channel and at least one tool driver of the first set of the tool drivers and one tool driver of the second set of tool drivers is positioned in a second channel, each of the first channel and the second channel comprising a first side, a second side and a bottom and further wherein a plurality of tool drivers in the first set of tool drivers are capable of being placed in the open position at the same time.

* * * * *

UNITED STATES PATENT AND TRADEMARK OFFICE

CERTIFICATE OF CORRECTION

PATENT NO. : 8,925,429 B2
APPLICATION NO. : 12/009461
DATED : January 6, 2015
INVENTOR(S) : Ronald L. Johnson et al.

It is certified that error appears in the above-identified patent and that said Letters Patent is hereby corrected as shown below:

IN THE CLAIM

Column 8, lines 48-54,

Replace -- 7. The device of claim 1 wherein each tool driver of the first set of tool drivers is positioned at least 90° around the circumference of the first end away from a neighboring tool driver of the first set and each tool driver of the second set of tool drivers is positioned at least 90° around the circumference of the second end away from a neighboring tool driver of the second set and each tool driver of the set. -- with 7. The device of claim 1 wherein each tool driver of the first set of tool drivers is positioned at least 90° around the circumference of the first end away from a neighboring tool driver of the first set and each tool driver of the second set of tool drivers is positioned at least 90° around the circumference of the second end away from a neighboring tool driver of the second set.

Signed and Sealed this
Fourth Day of August, 2015

Michelle K. Lee

Michelle K. Lee
*Director of the United States Patent and Trademark Office*